US009004179B2

(12) United States Patent
Chauffe

(10) Patent No.: US 9,004,179 B2
(45) Date of Patent: Apr. 14, 2015

(54) MULTI-ACTUATING SEAT AND DROP ELEMENT

(75) Inventor: Stephen J. Chauffe, The Woodlands, TX (US)

(73) Assignee: Team Oil Tools, LP, The Woodlands, TX (US)

( * ) Notice: Subject to any disclaimer, the term of this patent is extended or adjusted under 35 U.S.C. 154(b) by 134 days.

(21) Appl. No.: 13/408,026

(22) Filed: Feb. 29, 2012

(65) Prior Publication Data

US 2013/0118732 A1 May 16, 2013

Related U.S. Application Data

(60) Provisional application No. 61/448,346, filed on Mar. 2, 2011.

(51) Int. Cl.

| | |
|---|---|
| ***E21B 34/06*** | (2006.01) |
| ***E21B 33/12*** | (2006.01) |
| ***E21B 34/14*** | (2006.01) |
| *E21B 34/00* | (2006.01) |

(52) U.S. Cl.

CPC ..... *E21B 34/06* (2013.01); *E21B 33/12* (2013.01); *E21B 34/14* (2013.01); *E21B 2034/007* (2013.01)

(58) Field of Classification Search

USPC ..... 166/250.04, 373, 386, 64, 66, 102, 318, 166/332.5

See application file for complete search history.

(56) References Cited

U.S. PATENT DOCUMENTS

| | | | | |
|---|---|---|---|---|
| 1,949,498 | A | 3/1934 | Stone | |
| 2,200,505 | A | 5/1940 | Kerr | |
| 4,782,894 | A | 11/1988 | Lafleur | |
| 7,503,392 | B2 | 3/2009 | King | |
| 7,637,323 | B2 | 12/2009 | Schasteen et al. | |
| 8,403,068 | B2 * | 3/2013 | Robison et al. | 166/386 |
| 8,479,823 | B2 * | 7/2013 | Mireles | 166/332.2 |
| 8,607,811 | B2 * | 12/2013 | Korkmaz | 137/68.11 |
| 8,668,013 | B2 * | 3/2014 | O'Connell et al. | 166/318 |
| 2009/0308588 | A1 | 12/2009 | Howell et al. | |
| 2011/0067888 | A1 * | 3/2011 | Mireles | 166/386 |
| 2012/0048556 | A1 * | 3/2012 | O'Connell et al. | 166/308.1 |
| 2012/0085548 | A1 * | 4/2012 | Fleckenstein et al. | 166/373 |
| 2013/0025871 | A1 * | 1/2013 | O'Connell et al. | 166/318 |
| 2013/0118732 | A1 * | 5/2013 | Chauffe et al. | 166/250.04 |
| 2013/0186633 | A1 * | 7/2013 | Kitzman | 166/318 |

(Continued)

OTHER PUBLICATIONS

PCT Search Report dated Jun. 6, 2012 for PCT/US2012/027104 filed Feb. 29, 2012.

*Primary Examiner* — Jennifer H Gay

(74) *Attorney, Agent, or Firm* — MH2 Technology Law Group, LLP

(57) ABSTRACT

An apparatus includes a counter for tracking and communicating a number of plug drops through a longitudinal bore; a plug element adapted to be dropped into the longitudinal bore; and a valve defining a plug seat to be disposed within the longitudinal bore to catch the plug element when the plug element is dropped and when the number of plug drops as communicated by the counter exceeds a predetermined number. A method, includes: dropping a plurality of plugs down a longitudinal bore in which a plurality of plug seats are disposed; counting the number of plug drops from within the longitudinal bore; and catching one of the plugs at a preselected one of the plug seats when the number of plug drops exceeds a predetermined number.

22 Claims, 14 Drawing Sheets

(56) References Cited

U.S. PATENT DOCUMENTS

2013/0206402 A1* 8/2013 Coon ..... 166/255.1
2013/0220603 A1* 8/2013 Robison et al. ..... 166/250.04
2013/0264049 A1* 10/2013 Mireles ..... 166/64
2013/0299199 A1* 11/2013 Naedler et al. ..... 166/386
2014/0076542 A1* 3/2014 Whitsitt et al. ..... 166/250.1

* cited by examiner

MULTI-ACTUATING SEAT AND DROP ELEMENT

CROSS-REFERENCE TO RELATED APPLICATIONS

Priority is hereby claimed under 35 U.S.C. §119(e) to co-pending U.S. Provisional Application Ser. No. 61/448,346, entitled, "Multi-Actuating Seat and Drop Element", filed Mar. 2, 2011, in the name of the inventor Stephen Chauffe. This provisional application is also hereby incorporated by reference for all purposes as if set forth herein verbatim.

STATEMENT REGARDING FEDERALLY SPONSORED RESEARCH OR DEVELOPMENT

Not applicable.

BACKGROUND

1. Technical Field

The present disclosure relates generally to ball seats for use in oil and gas wells and more specifically to a ball seat having a seat that uses a ratcheting, indexing, or gear-type system to selectively open the sleeve for well fracturing. The present disclosure also relates to a plugging device for use in oil and gas wells and more specifically to a plugging device having a seating shoulder that uses a ratcheting, indexing or gear system to selectively land and shoulder on a ball seat.

2. Related Art

This section of this document introduces various pieces of the art that may be related to or provide context for some aspects of the technique described herein and/or claimed below. It provides background information to facilitate a better understanding of that which is disclosed herein. This is a discussion of "related" art. That such art is related in no way implies that it is also "prior" art. The related art may or may not be prior art. The discussion in this section is to be read in this light, and not as admissions of prior art.

Fracturing is a process that results in the creation of fractures in rocks, being an important industrial process in both oil and gas wells. The technique of fracturing (or "fracking") is used to increase or restore the rate at which fluids, such as oil, gas or water, can be produced from a reservoir, including unconventional reservoirs such as shale rock or coal beds. Fracturing enables the production of natural gas and oil from rock formations deep below the earth's surface (generally 5,000-20,000 feet or 1,500-6,100 m), At such depth, there may not be sufficient porosity and permeability to allow natural gas and oil to flow from the rock into the wellbore at economic rates. The fracture provides a conductive path connecting a larger area of the reservoir to the well, thereby increasing the area from which natural gas or liquid can be recovered from the targeted formation.

For example, a hydraulic fracture is formed by pumping the fracturing fluid into the wellbore at a rate sufficient to increase the pressure within the hole to a value in excess of the fracture gradient of the formation rock. The pressure causes the formation to crack, allowing the fracturing fluid to enter and extend the crack farther into the formation. Hydraulic fracture stimulation is commonly applied to wells drilled in low-permeability reservoirs.

The location of fracturing along the length of the borehole can be controlled by using ball-activated sliding sleeves (also known as stimulation valves, ball valves, etc.) below and above the region to he fractured. This allows a wellbore (a.k.a., the "borehole") to be progressively fractured along the length of the bore, without leaking fracture fluid out through previously fractured regions. Piping above the valves admits fracturing fluid and proppant into the working region. These stimulation valves typically use ban seats and plug elements.

Ball seats are generally known in the art. For example, U.S. Letters Pat. No. 7,503,392 (the "'392 patent"), entitled "DEFORMABLE BALL SEAT", and issued Mar. 17, 2009, to King, et al., portions of which are reproduced herein, discloses apparatuses for restricting fluid flow through a well conduit comprising a housing having a longitudinal bore and a collapsible seat disposed within the bore.

A typical ball seat has a bore or passageway that is partially restricted by a seat. The ball (e.g., drop plug or plug element) is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat (such as setting a packer). Ball seats are also used in cased and open hole completions, liner hangers, fracture systems, flow diverters, flow control equipment and sand control completions and systems.

A ball seat allows a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is typically determined by the largest diameter ball that can be transported down the conduit. The inner diameter of the seat is typically determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements or other downhole tools. Therefore, in current systems, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure and ball strength. Because ball strength is limited as discussed above, the seat inner diameter is typically reduced to increase the contact area (to decrease contact stress). The reduced seat inner diameter requires the ball previously dropped through the seat inner diameter to have a smaller outer diameter to pass through this seat inner diameter. This reduction in outer diameter of previous balls continues throughout the length of conduit until ball seats can no longer be utilized. Therefore, a string of conduit is limited as to the number of balls (and thus ball seats) that can be used which reduces the number of actuations that can be performed through a given conduit string.

Therefore, despite the numerous existing ball valve systems, the current technology only allows for a limited number of valves to be run in the conduit string due to incremental ball size limitations. This limitation also restricts the flow area through the lower valves as the flow area through the seats is minimal, Thus, the need exists for an improved ball valve system that eliminates the requirement for a reduction in ball outer diameter while also using a single ball size to increase the number of valves which may be installed on a given conduit string.

The present invention is directed to resolving, or at least reducing, one or all of the problems mentioned above.

SUMMARY

In a first aspect, the presently disclosed technique provides an apparatus for restricting flow through a conduit. The apparatus comprises a counter for tracking and communicating a number of plug drops through a longitudinal bore; a plug element adapted to be dropped into the longitudinal bore; and a valve defining a plug seat to be disposed within the longitudinal bore to catch the plug element when the plug element is dropped and when the number of plug drops as communicated by the counter exceeds a predetermined number.

In a second aspect, a plug element, comprises: a counter for tracking and communicating a number of plug drops through a longitudinal bore; and means for collapsing inwardly upon meeting a plug sent unless the communicated number of plug drops exceeds a predetermined number.

In a third aspect, a valve, comprises: a counter for tracking and communicating a number of plug drops through a longitudinal bore; and a collapsible plug seat that collapses upon meeting a plug unless the communicated number of plug drops exceeds a predetermined number.

In a fourth aspect, a method, comprises: dropping a plurality of plugs down a longitudinal bore in which a plurality of plug seats are disposed; counting the number of plug drops from within the longitudinal bore; and catching one of the plugs at a preselected one of the plug seats when the number of plug drops exceeds a predetermined number.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIGS. 2A, 2B, 2C, 2D, and 2E are diagrams illustrating an overview of a system using selectable ball valves;

Figures 1A, 1B, 1C, 1D, 1E:
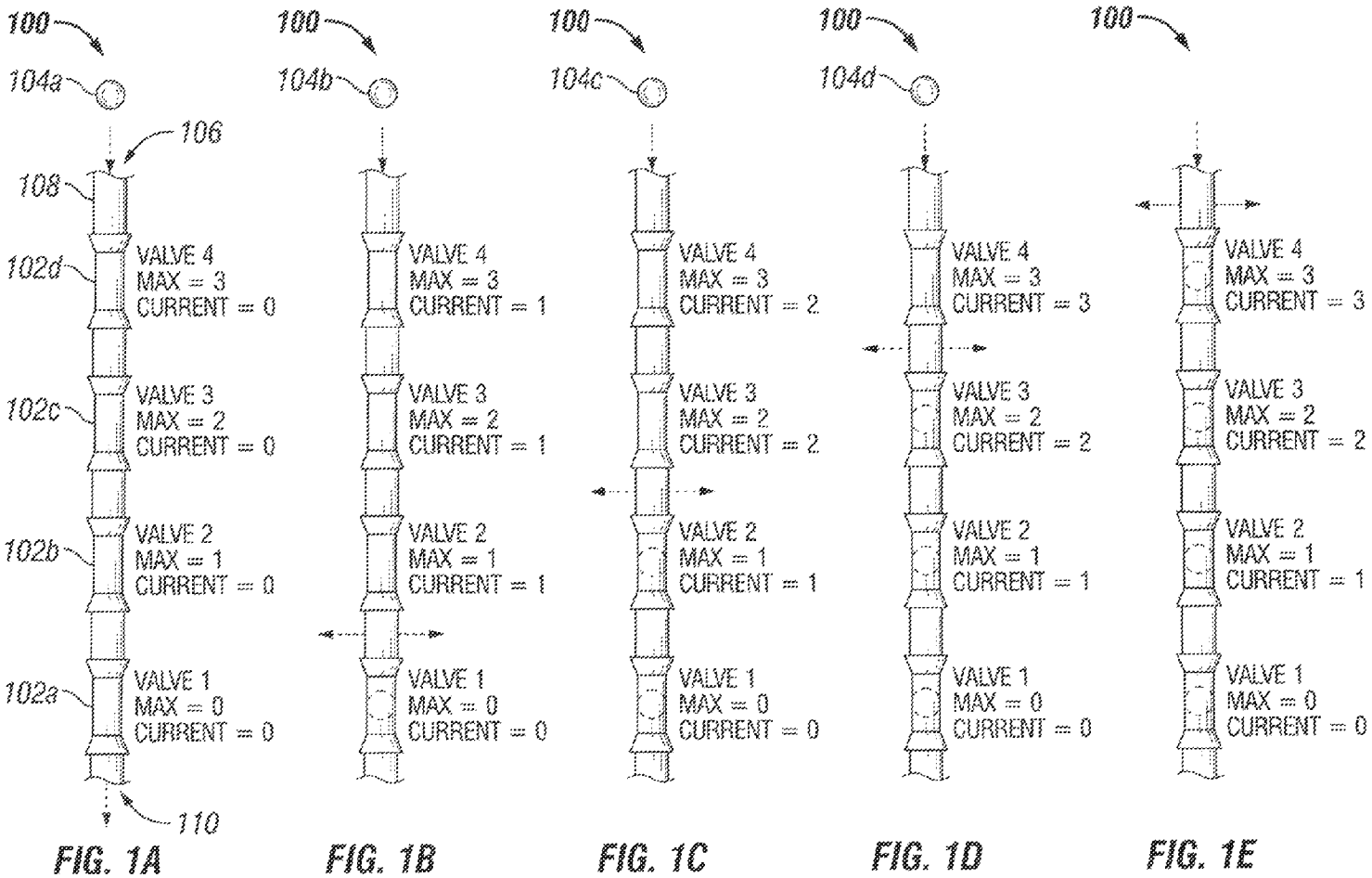
FIGS. 1A, 1B, 1C, 1D, and 1E are diagrams illustrating an overview of a system using ball actuated stimulation valves.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The present application discloses an improved ball seat valve system and method that solves the various limitations of current technology and, in at least some embodiments, provides a user with the ability to run a virtually unlimited number of actuated stimulation valves in a single conduit span without encountering the above-noted restrictions. The actuated stimulation valve system of the present invention uses balls of a single size for multiple ball valves, therefore eliminating the problems associated with pipe diameter reduction inherent in current systems that require multiple ball sizes.

Although the terms "ball seat" and "ball" are used herein to describe plug elements and plug seats, it is to be understood that a drop plug or other shaped plugging device or element may be used with the "ball seats" disclosed and discussed herein. For simplicity it is to be understood that the term "ball" includes and encompasses all shapes and sizes of plugs, balls, drops, plug elements, etc. In addition, it is to be understood that the term "ball seat" includes and encompasses all shapes and sizes of seats or profiles, which are used to receive plugging devices.

Generally speaking, a ball seat device typically includes a housing, an outwardly expanding seat, a plug element (e.g., a ball) and a ratcheting or indexing mechanism or equivalent electronic system. Each outwardly expanding ball seat may ratchet or cycle the ball seat device as each ball drops passed that ball seat. Typically, a ball drop may land on a ball seat where the conduit is pressurized to a predetermined pressure. Upon pressurization of the conduit, the ball may be pushed into or onto the seat which may cause the seat to expand outwardly, thus allowing the plug element to pass therethrough. The seat then retracts to the original contracted position (e.g., enabled to catch a ball drop).

According to a first embodiment of the present invention, the mechanical act of expanding the seat outwardly causes the internal gears/mechanisms to ratchet/index, cycle, and/or trigger (mechanically or electronically) the valve, The number of ratchets and/or cycles of the ball seat device are predetermined and upon the final cycle or ratchet, the ball seat can no longer move and thus functions as a typical ball seat by blocking the ball from further passage. This results in the ball resting in or on the ball seat and acting as a plugging device, even under increased pressure.

In this instance, applied pressure can activate one or more tools associated with this specific ball seat. For example, applied pressure may cause one or more ports to open in the well bore in a region adjacent the ball seat (acting as a valve) to allow fluid, e.g., fracking fluid, to exit the well bore through the ports and into the adjacent strata. The act of indexing, ratcheting or cycling can also be induced by a downward or lateral movement of the seat prior to the seat expanding outwardly.

Similarly, a plugging device (e.g., a ball or drop plug), may have an inwardly retracting shoulder dog which in turn cycles or ratchets the plugging device as it passes through each ball seat until it lands on the desired ball seat and comes to rest. The inwardly retracting shoulder dog cycles or ratchets the plugging device. The ratcheting or cycling action may also be caused by lateral movement of the shoulder dog. Typically, the plugging device may land on a ball seat and the conduit is pressurized to a predetermined pressure. Upon pressurization of the conduit, the plugging device is pushed into or onto the seat such that the plugging device seat shoulder retracts inwardly which in turn allows the plug element to pass.

The plugging device shoulder then expands to the original run-in position. As in the previous example, the mechanical act of retracting the shoulder inwardly causes the internal gears/mechanisms to ratchet and/or cycle the plugging device. The number of ratcheting and/or cycling cycles of the plugging device are predetermined and upon the final cycle or ratchet, the shoulder dogs can no longer move inwardly and thus the plugging device functions as a typical plugging device by resting on the desired seat, even under increased pressure. In this instance, applied pressure can activate the tools associated with this specific plugging device similar to the manner above-described. It should also be understood that the mechanical count does not necessarily have to be caused by the mechanical act of expanding the ball seat outwardly. The mechanical count can be caused by a trigger arm expanding outwardly causing the internal gears/mechanisms to ratchet/index, cycle, and/or trigger the valve. The number of ratchets and/or cycles of the trigger arm device are predetermined and upon the final cycle or ratchet, the ball seat is moved into place and thus functions as a typical ball seat by blocking the ball from further passage. This results in the ball resting in or on the ball seat and acting as a plugging device, even under increased pressure.

It should also be understood that the mechanical count does not necessarily have to be caused by the inwardly retracting shoulder dog, The mechanical count can be caused by a trigger arm retracting inwardly causing the internal gears/mechanisms to ratchet/index, cycle, and/or trigger the device. The number of ratchets and/or cycles of the trigger arm device are predetermined and upon the final cycle or ratchet, the shouldering dogs are moved into place and thus functions as a typical plugging device This results in the plugging device resting in or on the ball seat and acting as a typical plugging device, even under increased pressure.

Referring now to FIGS. 1A-1E, the actuated stimulation valve system 100 eliminates the unwanted pipe diameter reduction inherent to current systems that require multiple ball sizes by using a single size ball 104 and ball-actuated stimulation valves 102. For example, valve 102 a may be at one end of a conduit 108 (e.g., the bottom 110) followed by valve 102*b*, valve 102*c*, valve 102*d*, etc., until the desired number valves has been reached, or the opening 106 is reached. Each actuated stimulation valve 102 is able to track (e.g., using a mechanical ratcheting or gear type system and/or or an electronic sensor) the number of passing balls.

Once a preset number of passing balls has been reached, the actuated stimulation valve 102 will close thus catching the next ball to block off the valve. This opens the sleeve and diverts the pressure through openings in the well bore (which may be opened by the ball landing on the respective seat) to fracture the well. This concept can be used in both open-hole and cement hole scenarios. Although FIG. 1 illustrates a system wherein the ratcheting/cycling mechanism is integrated with the stimulation valves, it should recognized that the ratcheting/cycling mechanism may be integrated with a plugging device or drop ball and used in conjunction with a standard ball seat.

For example, referring to FIG. 1A, a conduit 108 is shown with four actuated stimulation valves 102 in the open position. Although only four actuated stimulation valves 102 are used in the following examples, a person ordinarily skilled in the art would appreciate that virtually an unlimited number of actuated stimulation valves 102 may be installed in a given conduit 108. Prior to dropping the first ball 104*a*, a force is able to pass straight through the pipe as indicated by the hashed arrows.

Each actuated stimulation valve 102 has a preset max ball value (denoted in FIGS. 1A-1E as "Max=x") and a current ball count value (denoted in FIGS. 1A-1E as "Current=y" and initially set to equal 0) configured such that when the current ball count value is equal to the preset max ball value, the next ball 104 dropped is "caught" by the actuated stimulation valve 102 thus closing off the valve and opening the sleeve at that level for well fracturing. For the following example, valve 102*a* has a max value of 0, valve 102*b* has a max value of 1, valve 102*c* has a max value of 2, and valve 102 d has a max value of 3. Since valve 102*a* has a preset max ball value and current ball count value both equal to 0, valve 102*a* is enabled to catch the first ball 104 a dropped.

Referring now to FIG. 1B, as the first ball 104 a fell through the preceding valves (valve 102*b*, valve 102*c*, and valve 102*d*), each preceding valve ratcheted, or cycled, the gear in each valve such that the current ball count value is incremented by 1. In FIG. 1B, the first ball 104 a dropped has firmly landed on the valve seat of valve 1 and thereby blocking valve 102*a* and diverting the fluid to fracture the well (as indicated by the hashed arrow). Since valve 102*b* now has a preset max ball value and current ball count value both equal to 1, valve 102*b* is enabled to catch the second ball 104*b* dropped.

Referring now to FIG. 1C, as the second ball 104*b* falls through the preceding valves (valve 102*c* and valve 102*d*), each preceding valve ratchets, or cycles, the gear in each valve such that the current ball count value is incremented by 1. The second ball 104*b* dropped has firmly landed on the valve seat therefore blocking valve 102*b* and diverting the force to fracture the well (as indicated by the hashed arrow). Since valve 102*c* now has a preset max ball value and current ball count value both equal to 2, valve 102*c* is enabled to catch the third ball 104*c* dropped.

Referring now to FIG. 1D, as the third ball 104*c* falls through the preceding valve (valve 102*d*), the preceding valve ratcheted, or cycled, the gear in each valve such that the current ball count value is incremented by 1. The third ball drop 104*c* has firmly landed on the valve seat therefore blocking valve 102*c* and diverting the force to fracture the well (as indicated by the hashed arrow). Since valve 102*d* now has a preset max ball value and current ball count value both equal to 3, valve 102*d* is enabled to catch the fourth ball 104*d* dropped.

Referring now to FIG. 1E, the fourth ball 104d has firmly landed on the valve seat therefore blocking valve 102 d and diverting the force to fracture the well (as indicated by the hashed arrow). Depending on the number of actuated stimulation valves 102 installed in a conduit 108, this process may continue for an unlimited number of cycles until each actuated stimulation valve 102 had caught a ball and/or diverted fluid to fracture a well.

There are a number of methods and ratcheting mechanism for incrementing and/or ratcheting the actuated stimulation valves 102. For example, a mechanical ratcheting, or cycling, system may operate such that when a ball lands in the valve seat, applied pressure (e.g., a pressure from the conduit's open end that pushes the ball) moves the valve seat down a notch and releases the ball (e.g., the seat expands outwardly causing the ball to pass). The ratcheting process may continue until the pre-set number of cycles has been completed, thus configuring the seat to catch the ball (e.g., the seat does not expand outwardly) allowing for the sleeve to open for fracturing at the desired level and diverting fluid, e.g., fracturing fluid, to fracture a well.

Alternatively, a gear system may be employed and would work in a similar manner. For example, a passing ball may trip the gear until a pre-set number of cycles has been completed, whereupon the seat may move inwardly thus catching the next ball allowing for the sleeve to open and diverting a fluid force to fracture a well.

A rolling ball seat is yet another possible technique for ratcheting, incrementing or progressing the gears in the valve. For example, as the ball passes through the seat, the ball makes contact with rolling segments (that may act like a ball seat) and rotates the segments as the ball passes. The process repeats until the pre-set number of cycles has been completed, thus catching the ball (e.g., the rolling ball seat rolls into a catching configuration) allowing for the sleeve to open and diverting a fluid force to fracture a well.

Another possibility is that a segmented ball seat expands to expel the ball, then relaxes again ready to catch the next ball. The process repeats until the pre-set number of cycles has been completed, thus catching the ball (e.g., the seat remains locked in the relaxed position), allowing for the sleeve to open and diverting a force to fracture a well. For example, as discussed in greater detail below, a timed gear with a pre-set timing may be used where each time the ball seat cycles, it moves to the next position.

Yet another possibility is a configuration where the ball or plug may land in a collet-type seat. Downward motion cycles the gear and places the seat in a larger cavity allowing the collet fingers to expand, thus expelling the ball. The inherent spring force of the collet puts the seat back in the original position once the seat has cycled. The seat may be segmented to move either downward or outward to (i) cycle the seat and (ii) expel the ball.

Regardless of the ratcheting/cycling process, the ball seat is enabled to expand in a downward and/or outward motion to cycle the ratchet mechanism and to release the ball drop until the preset maximum number of cycles has been met.

In some embodiments, the ratcheting and/or cycling device may be located in the plugging device where the shouldering dogs of the plugging device retract inwardly to cycle the device. For example, as the plugging device lands on the ball seat, applied pressure causes the shouldering dogs to retract inwardly allowing the plugging device to pass through the ball seat. The retracting process of the shouldering dogs cycles the plugging device. The process repeats itself until the preset number of cycles has occurred at which point the shouldering dogs will no longer retract. The plugging device then acts as a conventional plugging device and is enabled to land and seat on the next ball seat.

As an alternative to mechanical ratcheting and/or cycling devices, an electronic system may be used to track the ball drops and/or control the ball seat. Although potentially more expensive to apply, electronic sensors increase accuracy because they do not rely on mechanical methods of counting and thus, due to their fewer moving parts, are less likely to malfunction and/or seize. Electronic systems may also allow for a user to selectively control the valves using certain ball drops containing embedded information.

For example, photoelectric sensors may be used to sense the passing of a ball drop to determine if and when a ball seat should be expanded to release or enabled to catch the ball drop. A photoelectric sensor, or photoeye, is a device often used to detect the distance, absence or presence of an object by using a light transmitter, often infrared, and a photoelectric receiver. Photoelectric sensors are available in a number of arrangements, including, for example, (i) opposed (a.k.a. through beam), (ii) retroreflective and (iii) proximity-sensing (a.k.a. diffused). This system may be accomplished using, for example, a laser sensor that emits a beam of light from its transmitter and a reflective-type photoelectric sensor to detect the light beam reflected from the target. The through-beam type is used to measure the change in light quantity caused by the target crossing the beam.

In certain embodiments, the sensor (e.g., photoelectric sensors, radio-frequency identification ("RFID"), etc.) may be positioned before the ball valve allowing the ball seat to respond (e.g., expand or retract) in time to catch a particular ball drop. For example, referring to FIGS. 2A-2E, a conduit 208 is shown with four ball valves 202 in the open position.

Each ball valve 202 has a known ball identification number (denoted in FIGS. 2A-2D as "Ball ID=w") that corresponds to an identification number associated with a particular ball drop 204. The system is configured such that, when data from a ball drop 204 RFID tag matches the valve's 202 ball identification number, the valve 202 catches the ball drop 204 with the matching ball identification thus closing off the valve and opening the sleeve to fracture the well Although only four ball valves 202 are used in the following example, a person having ordinary skill in the art would appreciate that an unlimited number of ball valves 202 may be installed in a given conduit 208.

As in the previous example, prior to dropping the first ball 204, a force is able to pass straight through the pipe 208 as indicated by the hashed arrows. However, in this embodiment, the user may choose to selectively close a valve 202 using a particular ball drop 204. To accomplish this, ball drops 204 may contain RFID tags (e.g., a passive RFID tag that does not require a power source may be embedded within or applied to the surface of a ball drop) containing data or other information capable of triggering a sensor. To read the embedded RFID tag, one or more REID sensors 212 may be positioned before each ball valve 202. This is typically accomplished by providing an external electromagnetic field to initiate a signal transmission from the RFID tag.

Figure 2D:
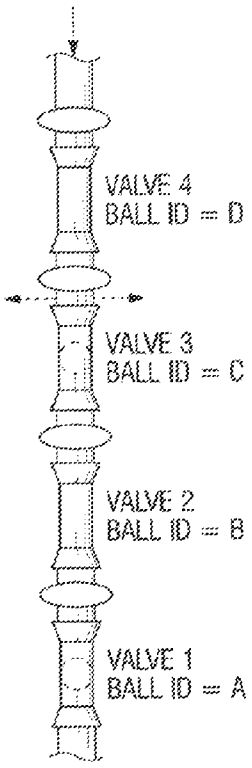
Figure 2C:
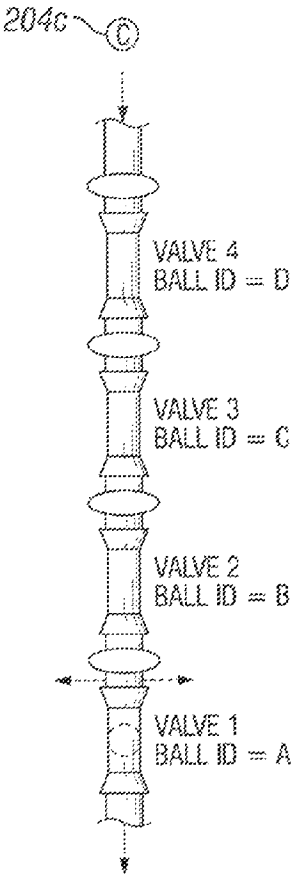
Figure 2B:
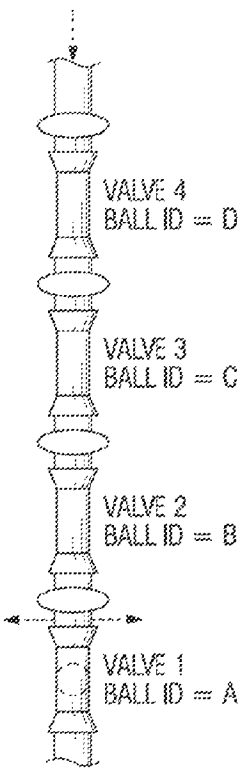
Figure 2A:
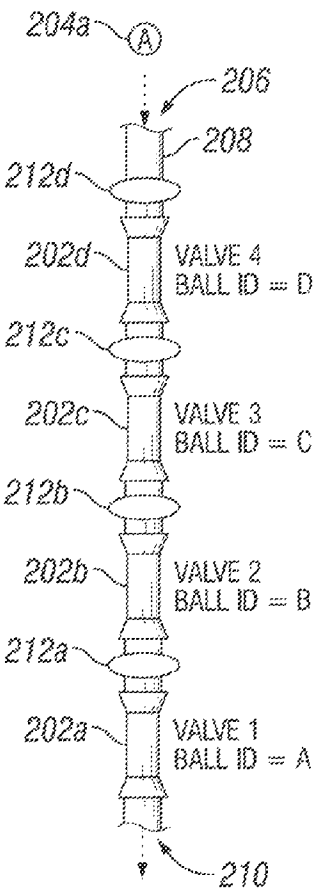

For example, referring now to the example in FIG. 2A, a user may choose to close valve 202*a*. To do so, the user would select the appropriate ball 204*a* with the corresponding ball identification number, in this case, ball drop 204*a*. As ball drop 204 a travels down conduit 208, RFID reader 212*a* will read the ball drop's 204*a* RFID tag and close valve 202*a*. As seen in FIG. 2(*b*), ball drop 204*a* has firmly landed on the valve seat, blocking valve 202*a* and diverting the force to fracture the well (as indicated by the dotted arrow).

Referring now to the example in FIG. 2C, suppose the user wishes to leave valve 202*b* open, but, close valve 202*c*. To do so, the user would select the appropriate ball 204*c* with the corresponding ball identification number, in this case, ball drop 204*c*. As ball drop 204*c* travels down conduit 208, REID reader 212*c* will read the ball drop's 204*c* RFID tag and close valve 202*c*. As seen in FIG. 2D, ball drop 204*c* has firmly landed on the valve seat, blocking valve 202*c* and diverting the force to fracture the well (as indicated by the dotted arrow).

Alternatively, rather than having multiple RFID sensors 212 installed along the conduit 208, a single RFID sensor 212 may be installed at the conduit 208 opening 206 to read a ball as it is being dropped in the conduit. In this situation, the ball drop 204 RFID data would be communicated to one or more valves and the selected valve (chosen by selecting a particular ball) would be enabled to lock and catch the ball 204 on the ball seat. Furthermore, the drop ball valves and/or ball drops may use a variety of electric components to control valve and seat movement, including, for example, electric actuators, step motors, piezoelectric elements and solenoids. Piezoelectric elements are particularly advantageous due to their compact sizes and accuracy of their expansion.

In certain embodiments, the sensor (e.g., photoelectric sensors, RFID, etc.) may trigger the plugging device's shouldering dogs to expand and thus land on the next ball seat.

Figure 3:
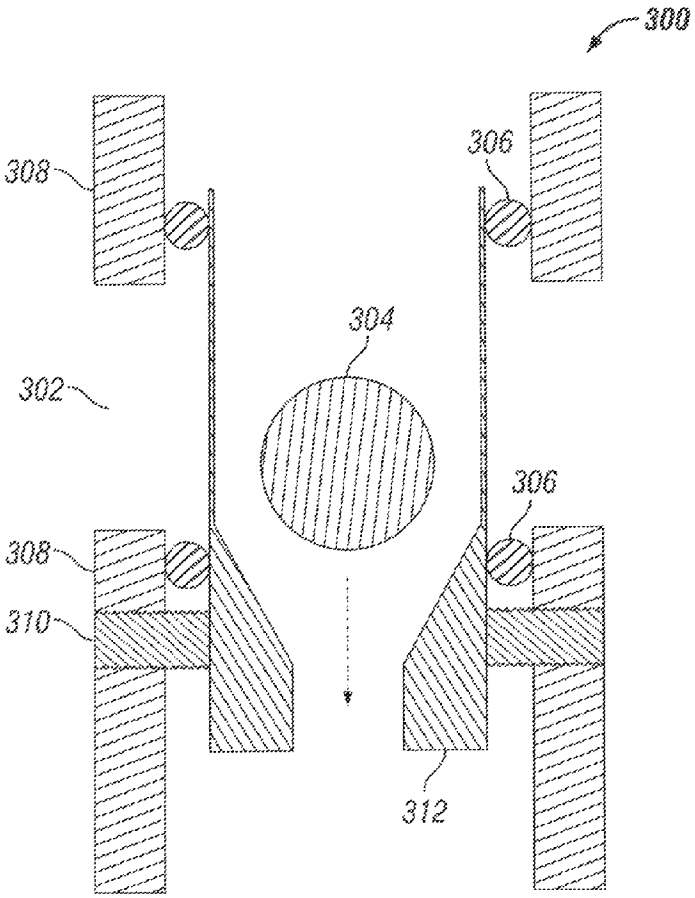
FIG. 3 is a diagram illustrating a cross-sectional view of a ball-activated stimulation valve.

Referring now to FIG. 3, a cross-sectional view of one particular embodiment of a ball-activated stimulation valve is shown installed on a conduit 308. The ball-activated stimulation valve system 300 typically comprises one or more O-rings 306, a plugging device 304 (e.g., a ball), a seat 312 and one or more shear screws 310 for adjusting the shear pressure of the seat 312. Once the plugging device 304 has landed on the seat 312, the valve is sealed and the ball seat is sheared down exposing the flow port 302. Additional pressure is diverted to the flow port 302.

Figure 4:
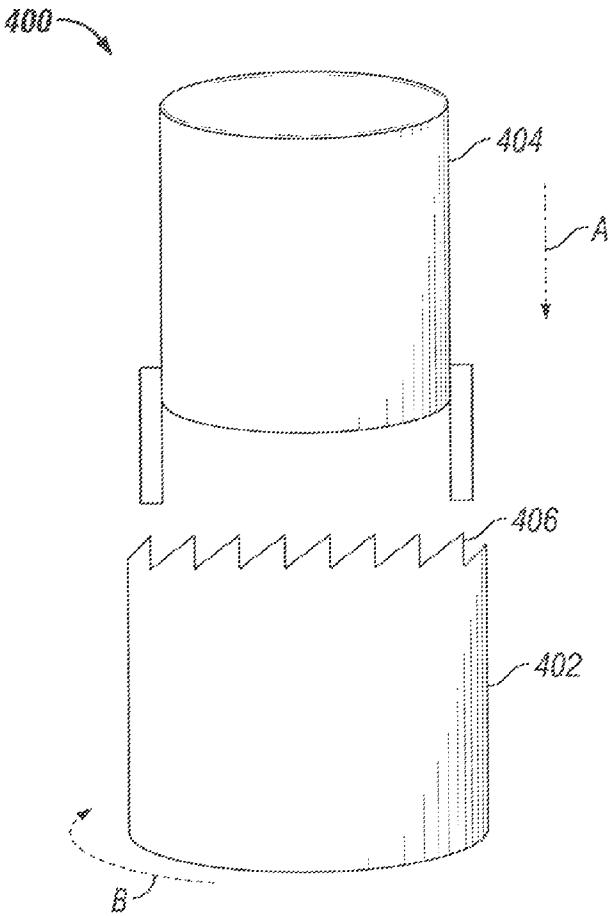
FIG. 4 is a diagram illustrating a cylindrical ratcheting/indexing mechanism.

FIG. 4 is a diagram illustrating an example cylindrical ratcheting mechanism 400 as may be used in some embodiments of the present invention. A downward motion A rotates, or cycles, the gear in direction B, but may also be designed to rotate in the opposite direction of direction B. Once the predetermined number of cycles have occurred, rotation B and/or downward motion A cannot occur thus preventing the ball seat from expanding. To set the number of cycles, a tooth on the gear may be ground to form a 90° angle such that the mating tooth cannot proceed to the next gear. For example, if the user wishes to set the gear for 4 cycles, the 4th tooth from the starting tooth may be ground to form a 90° angle prohibiting the gear from progressing to the next tooth.

A typical cylindrical ratcheting mechanism 400 may use one or more springs (e.g., a compression spring) located within the ratcheting mechanism 400. The initial spring, known as a ratchet, is often situated below the bottom half of the barrel 402. On the opposite side of the barrel 402, a spring may be located within the upper half of the tube 404. When the tube 404 is depressed, it relays pressure to the spring located within the upper half of the tube 404 where there are minute pits and teeth 406 which intertwine with each other (a locking mechanism) to rotate and track the barrel 402 and expand the seat, thereby releasing the plug before retracting the seat and returning to a locked position.

Such a cylindrical ratcheting mechanism 400 may be housed within the body of the stimulation ball valve so that the downward or outward motion of the ball seat would induce the cycling and/or ratcheting motion. Such a cylindrical ratcheting mechanism 400 may also be housed within the body of the plugging device such that any downward or inward motion of the shouldering dogs 704 (see FIGS. 7*a* and 7*b*) could induce the cycling and/or ratcheting motion.

Figure 5B:
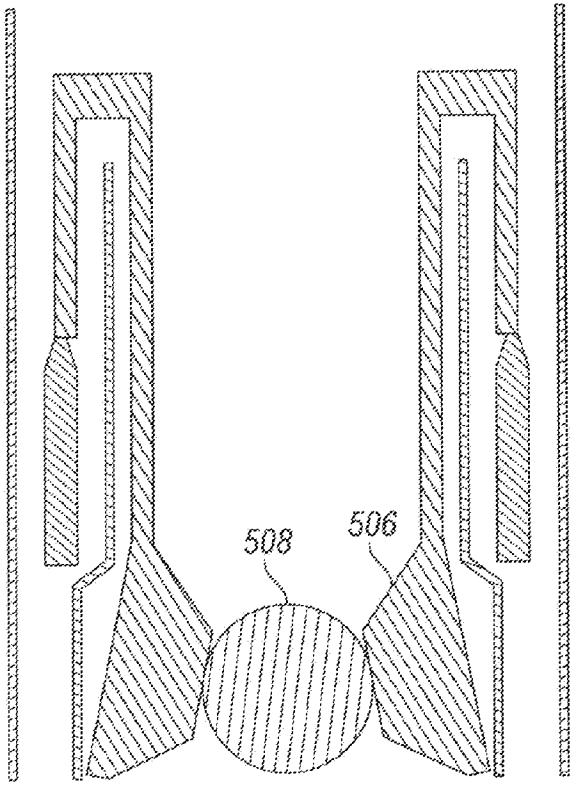
FIG. 5*b* is a diagram illustrating a cross-sectional view of a cylindrical ratcheting/indexing mechanism integrated with a ball-activated stimulation valve where a ball is being passed through the valve.
Figure 5A:
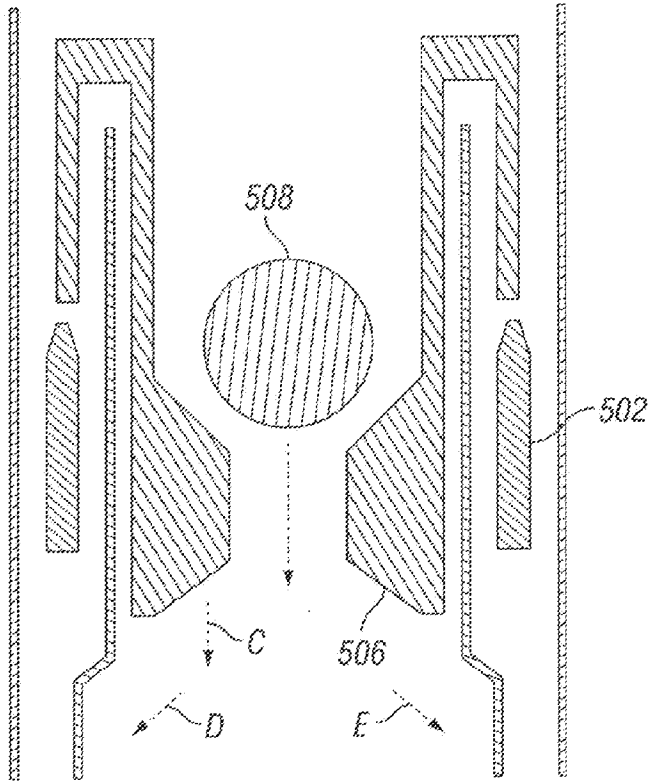
FIG. 5*a* is a diagram illustrating a cross-sectional view of a cylindrical ratcheting/indexing mechanism integrated with a ball-activated stimulation valve.

FIGS. 5*a*-5*d* are diagrams illustrating cross-sectional views of a cylindrical ratcheting mechanism 502 integrated with a ball-activated stimulation valve 500. FIG. 5*a* illustrates a downwardly and outwardly expanding ball seat that actuates a gearing or ratcheting mechanism having a predetermined number of cycles. Once all the cycles have occurred, the ball seat can no longer expand and thus functions as a standard ball seat, trapping the plugging device. Although the diagram of FIG. 5*a* illustrates a downwardly and outwardly expanding ball seat, a person ordinarily skilled in the art would appreciate that the seat may move downwardly or outwardly.

Referring now to FIG. 5*b*, as the ball drop 508 pushes the ball seat 506 downwardly in direction C, the cylindrical ratcheting mechanism 502 ratchets, or cycles, causing the ball seat 506 to move outwardly in directions D and E thereby releasing the ball drop 504. This process may cycle for a predetermined number of cycles as set by the gearing. For example, a notch (e.g., 90° tooth) may be carved into the ratcheting gear thereby preventing ratcheting after a predetermined number of cycles have been performed.

Figure 5C:
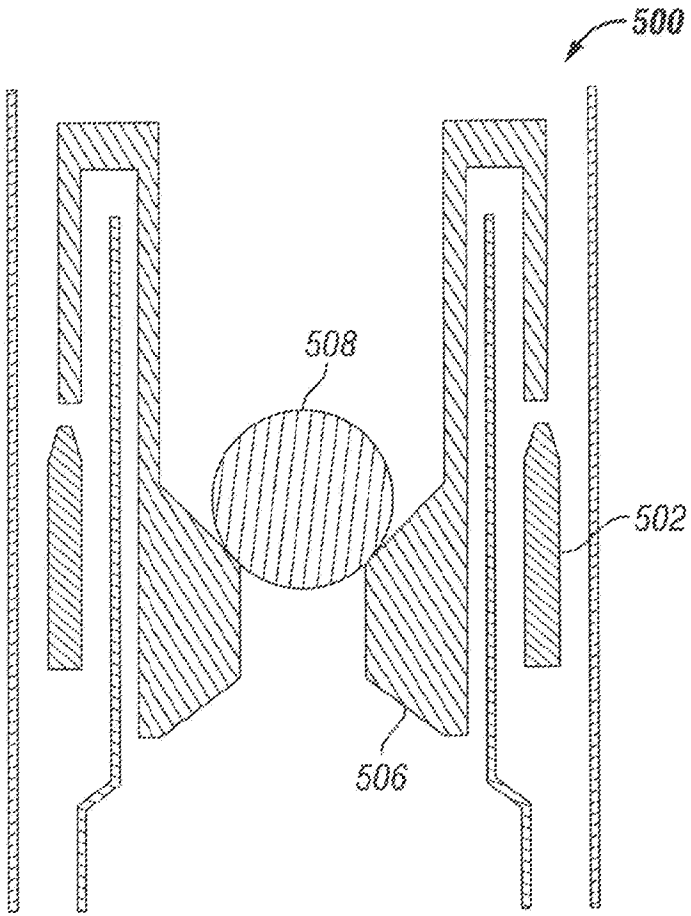
FIG. 5*c* is a diagram illustrating a cross-sectional view of a cylindrical ratcheting/indexing mechanism integrated with a cycled ball-activated stimulation valve where a ball is used to seal the valve.
Figure 5E:
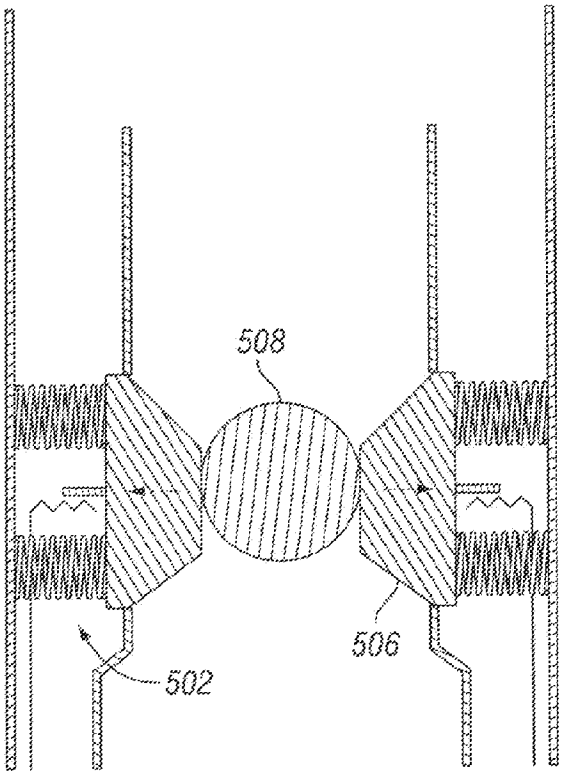
FIG. 5*e* is a diagram illustrating a cross-sectional view of a cylindrical ratcheting/indexing mechanism integrated with a ball-activated stimulation valve where a ball is being passed through the valve.
Figure 5D:
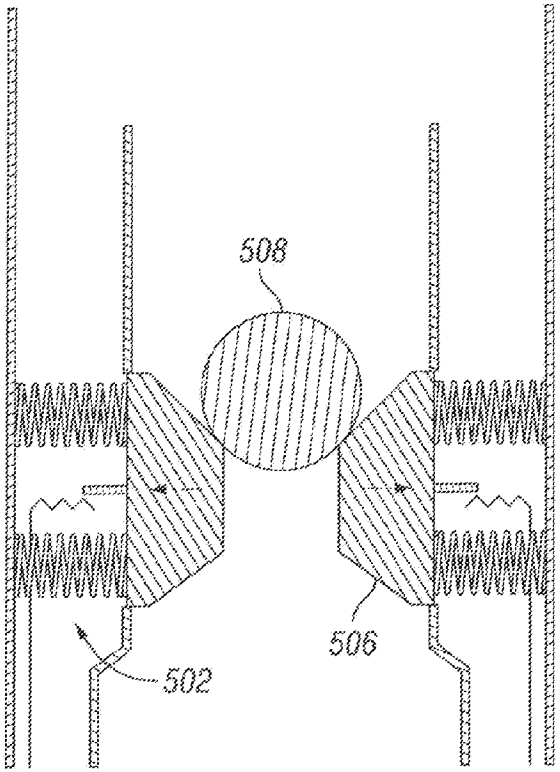
FIG. 5*d* is a diagram illustrating a cross-sectional view of a cylindrical ratcheting/indexing mechanism integrated with a ball-activated stimulation valve.

Referring now to FIG. 5*c*, once the predetermined number of cycles has been met, the ball seat 506 may be locked in place, thereby catching the next ball drop 508 and plugging the ball valve system 500 and diverting the force to fracture the well. With respect to FIGS. 5*d* and 5*e*, a person ordinarily skilled in the art would appreciate that the seat may move outwardly to both ratchet the valve and release the ball. Other gearing mechanisms or electronic equivalents as are well known in the art may be used in place of cylindrical ratcheting mechanism 502.

Another aspect of the present application is that the gear or ratcheting mechanism does not need to be coupled or integrated with the ball seat. On the contrary, the gear or ratcheting mechanism may be integrated with the plugging device. For example, the valve itself can have a very simple ball seat with minimal moving parts while the plugging device could have retractable or collapsible seat shoulder dogs that are timed and/or geared to expand or retract. As the plugging device travels through the ball seats, the seat shoulder dogs may retract and cycle the plug, thus accomplishing a similar effect to the configuration of FIGS, 5*a*-5*e*.

This method may be more attractive in, for example, a cemented scenario as there would be less concern about cement and/or fracture sand packing off in the gear or ball seat of the ball valve. One concept is that the plugging device has a seating shoulder dog larger than the ball seat's inner diameter. As the plug hits the seat, the shoulder retracts inwardly and cycles the plugging device. The plugging device then falls to the next seat.

Figure 6:
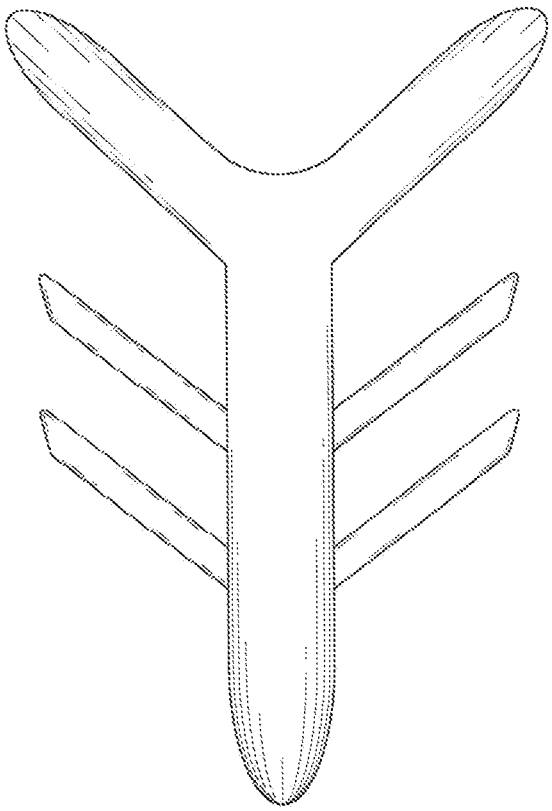
FIG. 6 is a diagram illustrating a pump-down plug style of plugging device.

FIG. 6 is a diagram illustrating a traditional pump-down plug-style plugging device. For further information on pump-down plugs, see, for example, U.S. Letters Pat. No. 1,949,498, entitled "PUMP-DOWPLUG", issued to Stone, et al., the entirety of which is incorporated herein by reference.

Figure 7B:
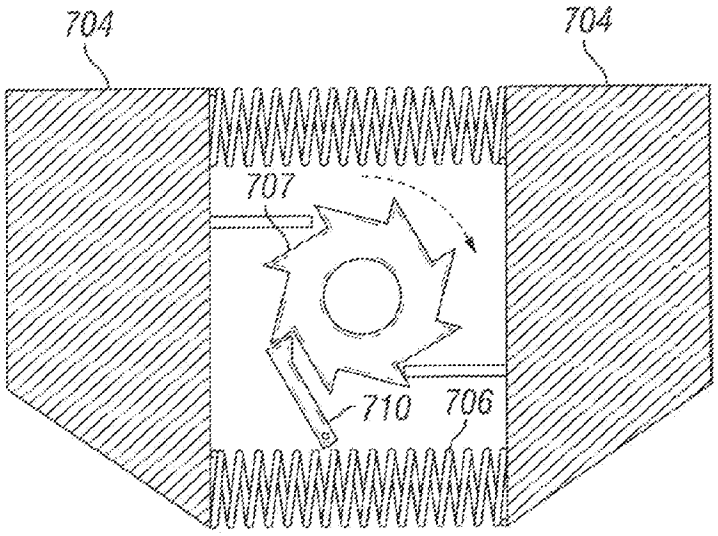
FIG. 7*b* is a diagram illustrating a magnified view of the gear or ratchet system of FIG. 7*a;*
Figure 7A:
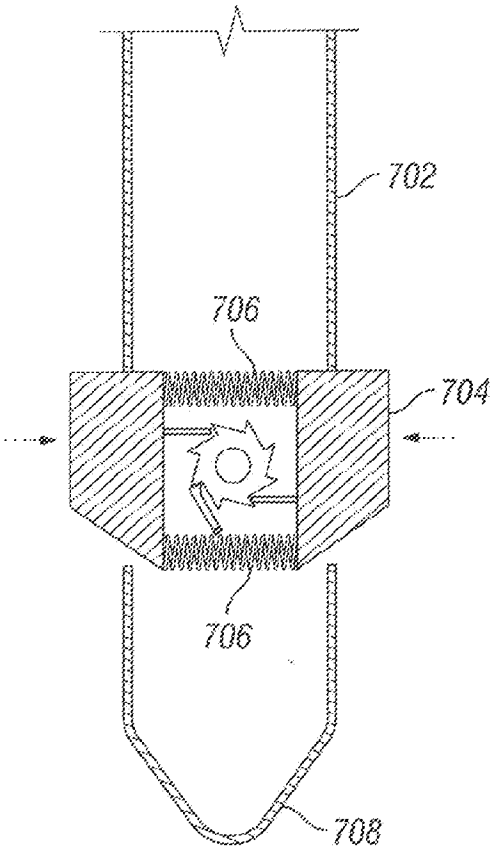
FIG. 7*a* is a diagram illustrating a plugging device with collapsible shouldering dogs and containing a gear or ratchet system.

FIGS. 7*a* and 7*b* are diagrams illustrating a plugging device 702 (e.g., a pump-down plug) containing an internal gear or ratchet system 707. Protruding from the sides of the plugging device 702 are one or more spring-loaded 706 shouldering dogs 704. In operation, the plugging device 702 travels nose-end 708 first down a conduit. As the plugging device 702 passes ball valve seats, the shouldering dogs 704 contract inwardly allowing the plugging device 702 to continue down the conduit. Each time the plugging device 702 passes a ball valve seat, the internal ratcheting mechanism 707 cycles until the preset maximum number of cycles is met.

Once the maximum number of cycles is met, the shouldering dogs 704 are unable to retract and thus the plugging device 702 is landed on the next ball valve seat. One or more additional pawls 710 may be used to lock the ratchet wheel 707 in place to prevent unwanted rotation. Although a ratchet wheel is depicted in the example shown in FIGS. 7*a*-7*b*, other gearing mechanisms or electrical equivalents as are well known in the art may be used in place of ratcheting mechanism 707.

Figure 8B:
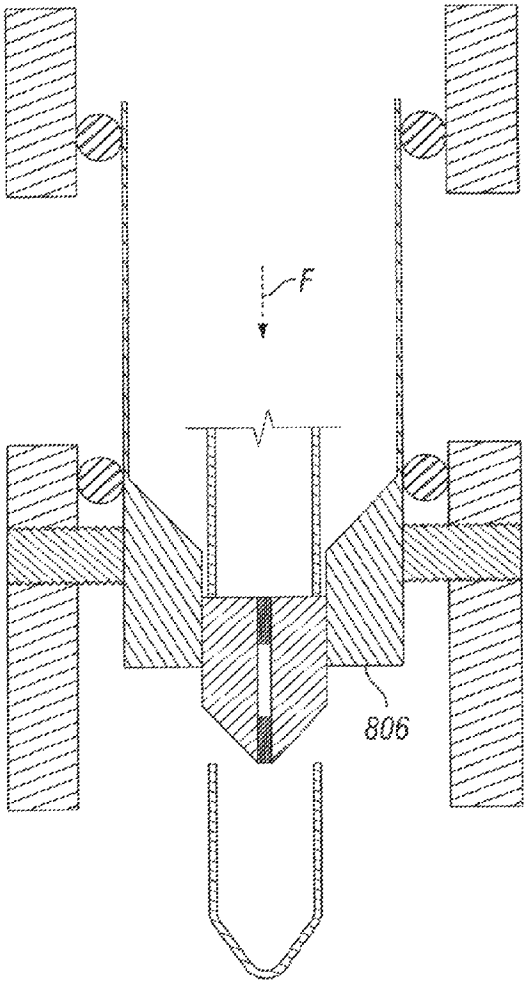
FIG. 8*b* is a diagram illustrating a plugging device with collapsible shouldering dogs and containing a gear or ratchet system landed on a ball seat where a plugging device is being passed through the valve.
Figure 8A:
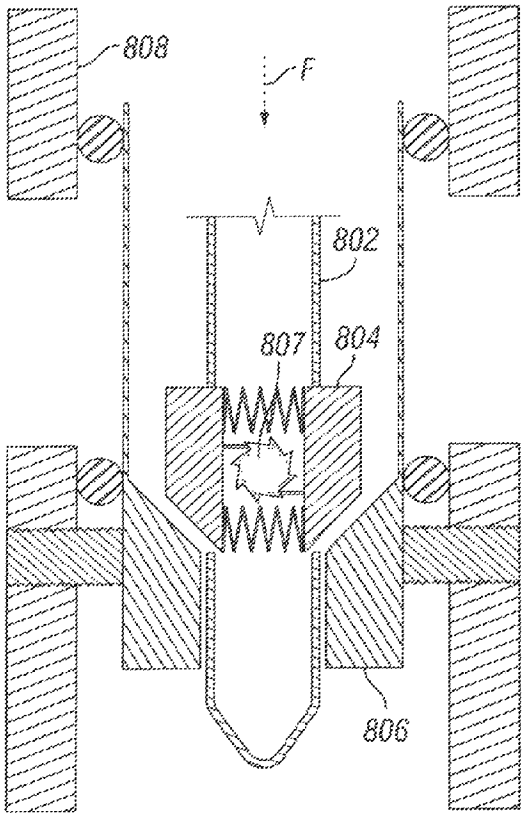
FIG. 8*a* is a diagram illustrating a plugging device with collapsible shouldering dogs and containing a gear or ratchet system landed on a ball seat.
Figure 8C:
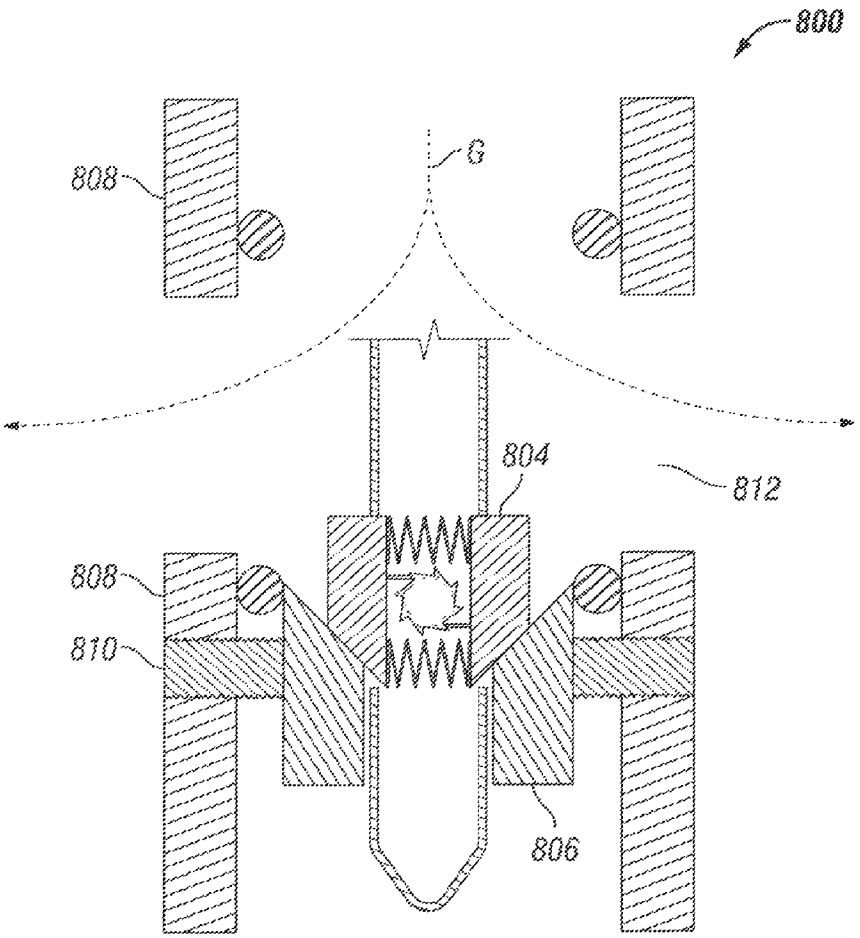
FIG. 8*c* is a diagram illustrating a plugging device with collapsible shouldering dogs containing a gear or ratchet system landed on a ball seat where a cycled plugging device is landed on the ball seat.

FIGS. 8*a*-8*c* are diagrams illustrating cross-sectional views of a plugging device 802 containing a gear or ratchet system 807 in operation. Referring now to FIG. 8*b*, as the plugging device 802 travels down conduit 808 in direction F, the internal gear or ratchet system mechanism 807 cycles. This causes the shouldering dogs 804 to move inwardly, toward the center of the plugging device 802, thereby allowing the plugging device 802 to travel past the valve seat. This process may cycle for a predetermined number of cycles as set by the gearing.

Referring now to FIG. 8*c*, once the predetermined number of cycles has been met, the shouldering dogs 804 may be locked in place causing the plugging device 802 to be landed on the valve seat 806, thereby plugging the valve system 800 and diverting the force G through flow port 812 to fracture the well. The valve seat 806 shear pressure may be adjusted using one or more shear screws 810. Although a ratchet wheel is depicted in the example shown in FIGS. 8*a*-8*c*, other gearing mechanisms or electrical equivalents as are well known in the art may be used in place of ratcheting mechanism 807.

Figure 9A:
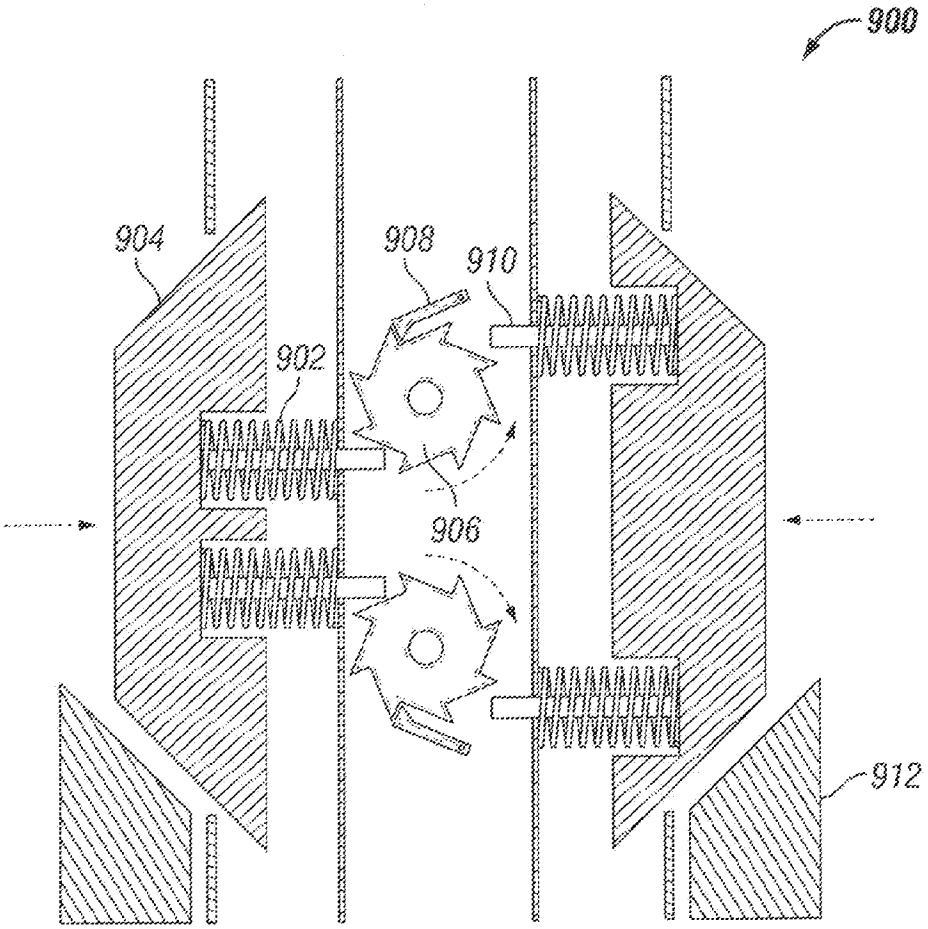
FIG. 9*a* is a diagram illustrating a collapsible shouldering dog and internal ratchet gear system.

FIG. 9*a* is a diagram illustrating an example internal spring loaded 902 ratchet gear system 900 installed within a plugging device. Inward motion of shouldering dogs 904 ratchets, or cycles, the ratchet gear system 900 by pushing the ratchet wheel 906 with pawl 910. A second pawl 908 may be installed to prevent the ratchet wheel 906 from performing any unwanted rotation. If the ratchet gear system 900 is installed within a plugging device, the ratchet gear system 900 could be triggered by passage through the valve seat 912.

Figure 9B:
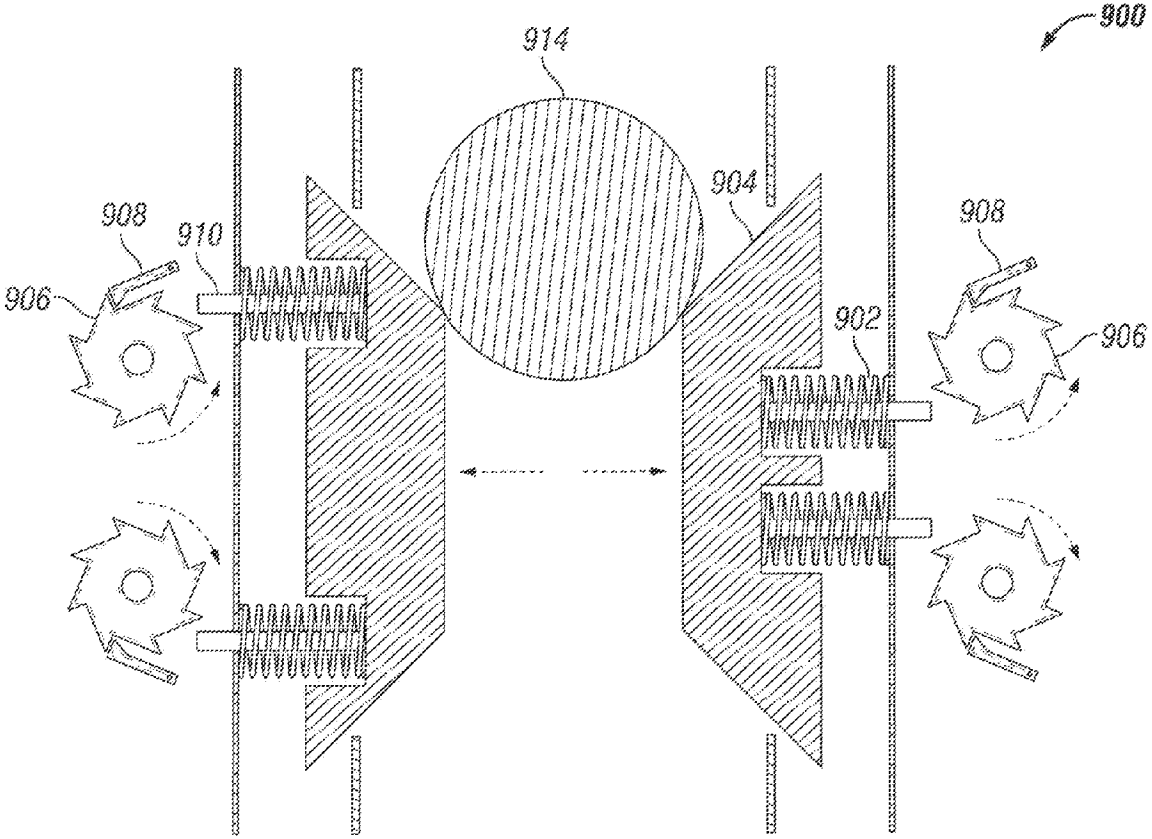
FIG. 9*b* is a diagram illustrating a ball seat with a ratchet mechanism.

However, as depicted in FIG. 9*b*, the ratchet gear system 900 may be installed within the valve to act as the valve seat whereby the ratchet gear system 900 would be triggered by a plugging device 914. Although ratchet wheels are depicted in the example shown in FIGS. 9*a*-9*b*, other gearing mechanisms or electrical equivalents as are well known in the art may be used in place of ratchet gear system 900.

Figure 10:
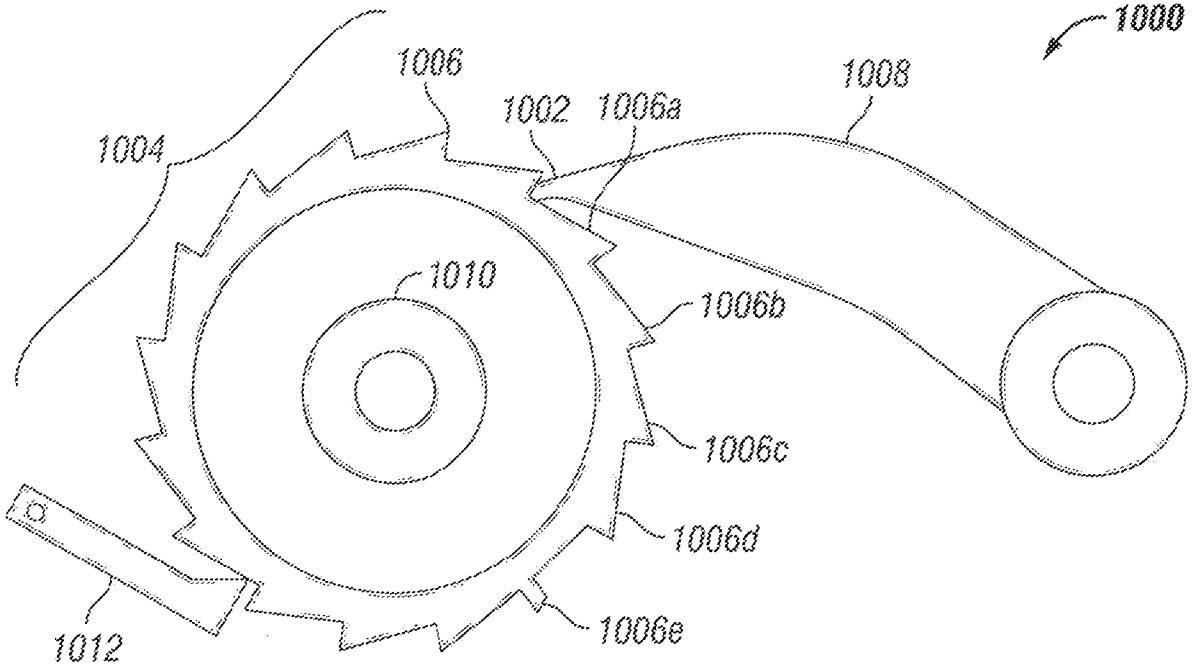
FIG. 10 is a diagram illustrating a ratchet mechanism.

FIG. 10 is a diagram illustrating an example ratchet mechanism for use with either a plugging device containing a gear or ratchet system or a valve seat containing a gear or ratchet system. The ratcheting mechanism 1000 generally comprises a shaft 1010, a ratchet wheel 1004 and a pawll1008. The ratchet wheel 1004 contains a plurality of teeth 1006 which are in contact with the pawl 1008 tip 1002.

The ratcheting mechanism typically has a spring (not shown in the figure) that is meant to pull the pawl 1008 against the ratchet wheel 1004 teeth 1006. The amount of backward motion possible varies with the pitch of the teeth. This motion could be reduced by using small teeth, and the expedient is sometimes used by placing several pawls side by side on the same axis, the pawls being of different lengths. The ratcheting mechanism 1000 may further comprise one or more additional pawls 1012 to prevent the ratchet wheel 1004 from making any unwanted movement or rotation.

When integrated with a valve seat, a ball drop triggers the valve such that the ratchet wheel 1004 may move counterclockwise and pawl 1008 will slide over a tooth 1006 incline and lock the wheel 1004 in place until the next drop triggers the ratchet mechanism. This process cycles until a predetermined number of cycles has been met. For example, the mechanism in FIG. 10 has a starting tooth 1006*a* and has been configured to run for 4 cycles by cutting a 90-degree angle in the fifth tooth 1006*e*. The 90° out eliminates the slope thereby preventing the pawl 1008 from progressing to the next tooth. Once this has occurred, the next ball drop will be caught by the ball valve and used to plug the ball valve system and divert the force to fracture the well. Although the ratchet wheel 1004 of FIG. 10 moves in a counterclockwise direction, the ratchet wheel 1004 may easily be configured to rotate in clockwise direction by, for example, simply reversing the tooth angle.

In another embodiment (not shown), a ratchet gear mechanism may be enabled for use with the present ball drop system. When the gear mechanism is integrated with a ball seat, a ball drop triggers the ball seat to expand outwardly such that pawl causes ratchet wheels to rotate. One or more additional pawls may be used to lock the ratchet wheel in place until the next ball drop triggers the ratchet gear mechanism. A spring may be used to push the ball seat back to the original position after the drop ball has passed through.

This process cycles until a predetermined number of cycles has been met. For example, a starting tooth may be configured to run for 3 cycles by filing down the fourth tooth. The filing eliminates any contact between the fourth tooth and pawl thereby preventing the pawl from progressing to the next tooth. Once this has occurred, the next ball drop will be caught by the ball valve and used to plug the ball valve system and divert the force to fracture the well. Although this embodiment employs a mechanical ratcheting system, the ratchet wheels could easily be replaced with other gearing mechanisms as are well known in the art or an electrical sensor or switch to create an electronic system.

While the description on far has centered on fracture applications, it would be clear to those of skill in the art having the benefit of this disclosure that it can equally be applied to other systems or conduit/pipe systems that use plugging devices and ball seats.

Thus, an apparatus for restricting flow through a conduit, the apparatus comprises: a counter for tracking and communicating a number of plug drops through a longitudinal bore; a plug element adapted to be dropped into the longitudinal bore; and a valve defining a plug seat to be disposed within the longitudinal bore to catch the plug element when the plug element is dropped and when the number of plug drops as communicated by the counter exceeds a predetermined number. The plug element may be, for example, a ball or a pump down plug.

The counter may be mechanical or electronic in nature. Mechanically, it might consist of, for example, a series of gears and ratchets. The electronic embodiments might operate optically through photosensor technology or through radio frequencies, such as RFID. The presently disclosed technique admits wide variation in how the counter may be implemented. The counter may be located on either the plug or the plug element.

In embodiments where the counter is located on the plug element, the plug element, may comprise not only the counter, but also means for collapsing inwardly upon meeting a plug sent unless the communicated number of plug drops exceeds a predetermined number. In the illustrate embodiments, the means is one or more shouldering dogs that collapse inwardly upon encountering a plug seat until the counter indicates that the predetermined number of drops have been performed. Note that this embodiment infers the number of drops from the number of plug seats encountered. However, this is by way of example and illustration but one means for performing the disclosed function. Other means equivalent in structure that perform the function may be used in other, alternative embodiments.

In embodiments where the counter is located on the plug seat, a valve may comprise not only the counter, but a collapsible plug seat that collapses upon meeting a plug unless the communicated number of plug drops exceeds a predetermined number. The plug seat may collapse outwardly or downwardly in various embodiments. Note that this embodiment can count directly the number of plug drops.

In use, a method, comprises dropping a plurality of plugs down a longitudinal bore in which a plurality of plug seats are disposed. The number of plug drops is counted from within the longitudinal bore. For example, the number of drops may be counted inferentially by the plug element or directly by the plug seats, both as described above. At each plug seat, if the predetermined number of plug drops has not occurred, then the plug element passes through the plug seat as one or more structures and/or means collapses as described above and shown in the drawings. When the number of plug drops exceeds a predetermined number, then a preselected one of the plug seats catches the plug element.

The above-cited patents and patent publications are hereby incorporated by reference in their entirety herein, because they provide additional background information which may be considered relevant to the present application. In particular, the following patents are hereby incorporated by reference as if set forth verbatim herein:

U.S. Letters Pat. No. 7,503,392 (the "'392 patent"), entitled "DEFORMABLE BALL SEAT", and issued Mar. 17, 2009, to King, et al.; and U.S. Letters Pat. No. 1,949,498, entitled "PUMP-DOWPLUG", issued to Stone, et al.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus for restricting flow through a conduit, the apparatus comprising:

a counter for tracking and communicating a number of plug drops through a longitudinal bore;

a plug element adapted to be dropped into the longitudinal bore; and a valve defining a plug seat to be disposed within the longitudinal bore to catch the plug element when the plug element is dropped and when the number of plug drops as communicated by the counter exceeds a predetermined number, wherein the counter comprises a pawl and a ratchet comprising a plurality of teeth, the plurality of teeth comprising at least one angled tooth and at least one end tooth, and wherein the pawl is configured to engage one of the plurality of angled teeth prior to the number of plug drops reaching the predetermined number, and to engage the end tooth when the number of plug drops equals or exceeds the predetermined number.

2. The apparatus according to claim 1, wherein a single plug element size is used for multiple apparatus in a conduit defining the longitudinal bore.

3. The apparatus according to claim 1, wherein the counter comprises a part of the plug element.

4. The apparatus according to claim 3, wherein the counter is actuated by an inwardly collapsing structure of the plug element as the plug element passes through other plug seats disposed in the longitudinal bore.

5. The apparatus according to claim 4, wherein the inwardly collapsing structure does not collapse when it meets the plug seat and the number of plug drops exceeds the predetermined number.

6. The apparatus according to claim 3, wherein the plug element does not inwardly collapse a structure thereon when it meets the plug seat and the number of plug drops exceeds the predetermined number.

7. The apparatus according to claim 3, wherein the counter includes a tripper arm expanding outwardly to advance the counter.

8. The apparatus according to claim 1, wherein the plug element includes an inwardly collapsing structure that collapses upon meeting a plug seat unless the number of plug drops exceeds the predetermined number.

9. The apparatus according to claim 1, wherein the counter comprises a part of the plug seat.

10. The apparatus according to claim 9, wherein the counter is actuated by expanding the plug seat.

11. The apparatus according to claim 10, wherein the plug seat is prevented from longitudinal movement in at least one direction by engagement between the pawl and the end tooth such that the plug seat does not expand when the number of plug drops exceeds the predetermined number.

12. The apparatus according to claim 9, wherein the counter includes a trigger arm that is configured to expand outwardly to advance the counter.

13. The apparatus of claim 9, wherein the plug seat expands outwardly or downwardly.

14. The apparatus of claim 1, wherein the plug seat expands to pass the plug element unless the number of plug drops exceeds the predetermined number.

15. The apparatus according to claim 1, wherein the pawl is coupled with the plug seat and moves longitudinally along with the valve seat.

16. The apparatus according to claim 1, wherein the ratchet is rotatable independently of the plug seat.

17. The apparatus according to claim 1, wherein the ratchet is disposed around the plug seat.

18. A valve, comprising:

a counter for tracking and communicating a number of plug drops through a longitudinal bore; and a collapsible plug seat that collapses upon meeting a plug unless the communicated number of plug drops exceeds a predetermined number, wherein the counter comprises a pawl and a ratchet comprising a plurality of teeth, the plurality of teeth comprising at least one angled tooth and at least one end tooth, and wherein the pawl is configured to engage one of the plurality of angled teeth prior to the number of plug drops reaching the predetermined number, and to engage the end tooth when the number of plug drops equals or exceeds the predetermined number, the pawl engaging the end tooth preventing the collapsible plug seat from collapsing.

19. The valve of claim 18, wherein the counter is mechanical or electrical.

20. The valve of claim 18, wherein the collapsible plug seat collapses downwardly or outwardly.

21. A method, comprising:

dropping a plurality of plugs down a longitudinal bore in which a plurality of plug seats are disposed;

counting the number of plug drops from within the longitudinal bore using at least one of the plug seats, wherein counting comprises:

moving a first barrel of the at least one of the plug seats longitudinally by interaction with at least one of the plurality of plugs, such that the first barrel engages one or more teeth of a plurality of angular teeth of a ratchet, wherein the first barrel engaging the one or more teeth of the plurality of angular teeth causes the ratchet to rotate with respect to the first barrel; and catching one of the plugs at a preselected one of the plug seats when the number of plug drops exceeds a predetermined number, wherein the first barrel engages an end tooth of the ratchet when the number of plug drops exceeds the predetermined number, such that the plug seat is prevented from expanding.

22. The method of claim 15, wherein the plug seats count the number of plug drops.

* * * * *